United States Patent [19]

Philobos

[11] Patent Number: 4,643,276

[45] Date of Patent: Feb. 17, 1987

[54] ELEVATOR SYSTEM

[75] Inventor: Alexander M. Philobos, Edison, N.J.

[73] Assignee: Westinghouse Electric Corp., Pittsburgh, Pa.

[21] Appl. No.: 729,603

[22] Filed: May 2, 1985

[51] Int. Cl.[4] ..... B66B 5/02

[52] U.S. Cl. ..... 187/107

[58] Field of Search ..... 187/29, 73

[56] References Cited

U.S. PATENT DOCUMENTS 4,056,169 11/1977 Showalter ..... 187/29

*Primary Examiner*—W. E. Duncanson, Jr.

*Attorney, Agent, or Firm*—D. R. Lackey

[57] ABSTRACT

A traction elevator system having an elevator car and a counterweight. Counterweight derailment, such as due to an earthquake, is detected via a vertically oriented wire strung tautly in the hoistway, a metallic ring on the counterweight which encircles the wire, control connected to the wire for detecting contact between the ring and wire, and a switch on the counterweight which enables the control to detect contact between the ring and wire only after predetermined abnormal horizontal movement of the counterweight.

3 Claims, 4 Drawing Figures

ELEVATOR SYSTEM

BACKGROUND OF THE INVENTION

1. Field of the Invention

The invention relates in general to elevator systems, and more specifically to arrangements for detecting the derailment of the counterweight in a traction elevator system, such as caused by an earthquake.

2. Description of the Prior Art

Damaging earthquakes are likely to occur in certain well defined earthquake zones of the world. The need for earthquake detection, or damage detection, in certain elevator systems installed in earthquake zones was recognized after the California earthquake in 1971.

U.S. Pat. No. 3,791,490 discloses an arrangement for detecting abnormal horizontal counterweight movement, with the arrangement including a vertically oriented wire strung tautly in the hoistway. A metallic ring mounted directly to the counterweight frame encircles the wire without contact therewith during normal operation. Horizontal movement of the counterweight such that the ring contacts the wire, grounds the wire through the counterweight frame, wire supporting ropes, drive sheave and bearings. When grounding of the wire is detected, the resulting signal is used to modify the operation of the elevator system. For example, the elevator car may be stopped with regard to floor level, and the car may then be operated at a reduced speed to the closest floor in a direction away from the counterweight.

With certain buildings and building heights it is possible for the wire to sway and/or vibrate to such an extent that it contacts the ring on the counterweight during normal operation of the elevator system. When this happens, the elevator car is stopped and taken out of service unnecessarily.

SUMMARY OF THE INVENTION

The present invention improves upon the ring and wire counterweight derailment detection arrangement of the prior art by eliminating false triggering due to wire sway or vibration. The improvement is accomplished with minimal hardware and installation cost, the improvement is provided without the necessity of running a trail cable to the counterweight, and the improvement is obtained without changing or modifying the detection control circuitry. Further, the improved arrangement may be added to existing elevator installations, as easily as being applied to a new elevator installation. Instead of connecting the metallic ring directly to the grounded counterweight frame, it is insulatingly mounted on the counterweight. A wire is connected from the electrically insulated metallic ring to ground through a switch, such as a microswitch, with the switch having an actuating arm biased against the nose guide surface of one of the counterweight guide rails. As long as the actuating arm is biased against the guide surface of the guide rail, the switch is held in an open position, and inadvertent contact between the ring and wire is not detectable. If the counterweight should move outside of its normal vertically guided path, such as due to an earthquake, to such an extent that the actuating arm is moved off of the guide rail guide surface, the switch immediately closes its contacts and the detection circuitry is enabled.

BRIEF DESCRIPTION OF THE DRAWINGS

The invention may be better understood and further advantages and uses thereof more readily apparent when considered in view of the following detailed description of exemplary embodiments, taken with the accompanying drawings in which.

DESCRIPTION OF THE PREFERRED EMBODIMENTS

Figure 1:
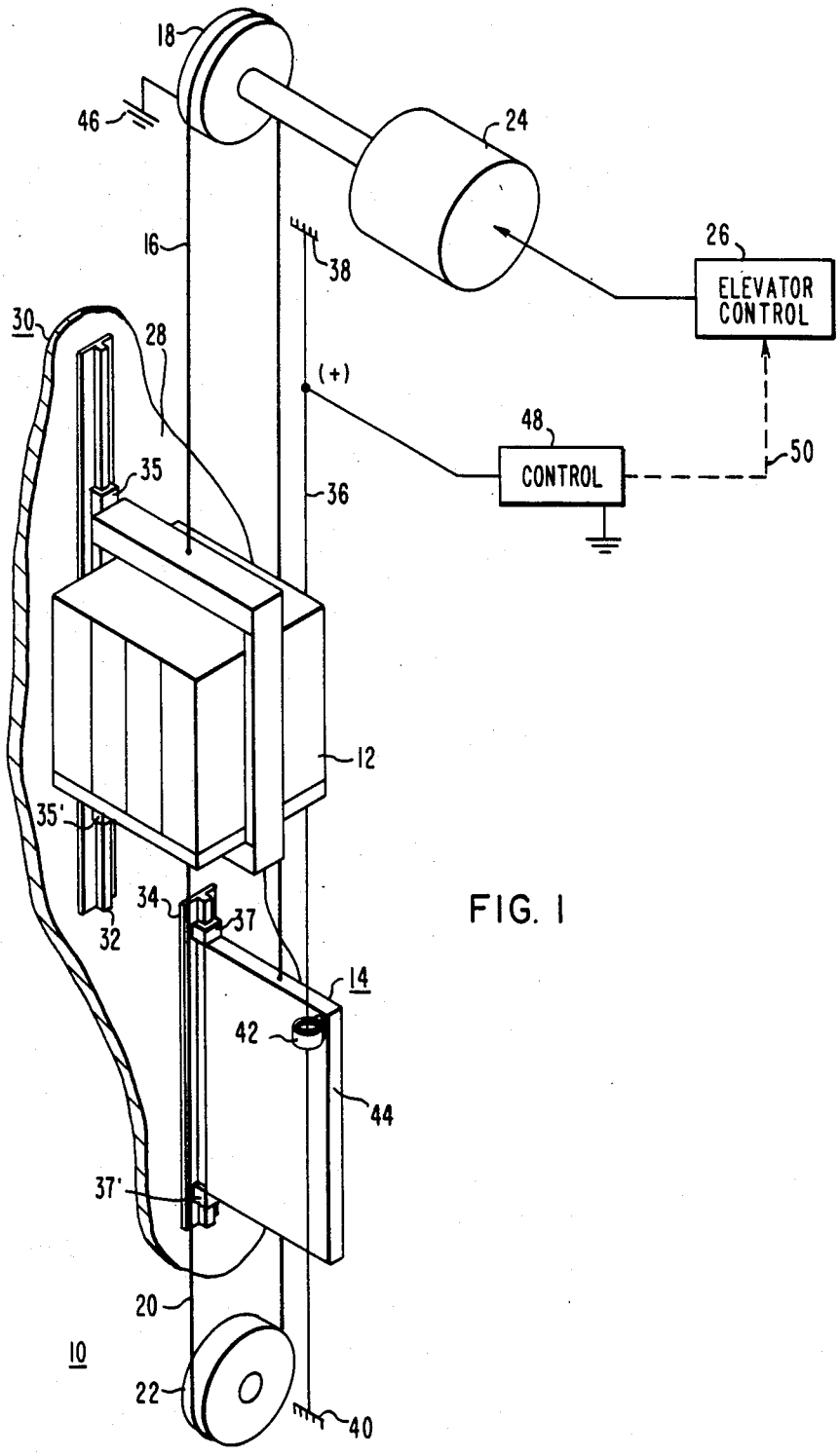
FIG. 1 is a perspective view of an elevator system which may be constructed according to the teachings of the invention.

Referring now to FIG. 1, there is shown a perspective view of an elevator system 10 of the traction type having an elevator car 12 and a counterweight 14 interconnected via a plurality of metallic, wire ropes 16 which are reeved over a metallic, grounded, traction sheave 18. Compensation ropes 20 interconnect the bottoms of the car and counterweight via a compensator sheave 22. Traction sheave 18 is driven by a traction drive machine 24, which may include an AC or DC drive motor. Drive machine 24 is controlled by elevator control 26, such as set forth in detail in U.S. Pat. Nos. 3,750,850 and 4,416,352. Elevator car 12 and counterweight 14 are mounted for guided, vertical movement in a building 30 via car and counterweight guide rails, such as car and counterweight guide rails 32 and 34, respectively, and guide roller assemblies mounted on the car and counterweight which coact with the guide rails. For example, guide roller assemblies 35 and 35' are shown mounted on elevator car 12 and coacting with guide rail 32, and guide roller assemblies 37 and 37' are shown mounted on counterweight 14 and coacting with guide rail 34. Guide rails similar to guide rails 32 and 34 would also be disposed on the opposite sides of the car and counterweight, but they are not shown in FIG. 1 in order to clarify the drawing.

A prior art counterweight derailment detector includes a vertically extending metallic wire 36 tautly strung the length of the hoistway 28, between first and second electrically insulated mounting termination points 38 and 40, respectively. In a preferred embodiment, wire 36 is disposed in the space between the elevator car 12 and counterweight 14. A metallic ring 42 is mounted on the counterweight 14, such that it is electrically grounded, e.g., by mounting it directly on the metallic counterweight frame 44 which is grounded through the wire ropes 36 and traction sheave 18, as indicated at 46. Control 48 applies an electrical potential to wire 36, it detects contact between wire 36 and ring 42, and it modifies the elevator control 26, as indicated by broken line 50, such as by stopping the elevator car 12 and then moving it to floor level in a travel direction away from the counterweight 14. Since suitable control 48 is shown in the hereinbefore mentioned U.S. Pat. No. 3,791,490, and since the present invention does not modify the control, it will not be described in detail.

Since building sway and/or wind currents in the hoistway may cause wire 36 to vibrate and sway, with the amount of vibration or sway being proportional to building height, it is possible for contact to occur between the wire 36 and ring 42 without abnormal horizontal movement of the counterweight. This results in an unnecessary stop of the elevator car 12, as well as the loss of the elevator car from service until authorized personnel reset the control.

The present invention overcomes the possibility of false triggering of the ring/wire counterweight derailment detector arrangement, with little added hardware and installation costs, and without running a traveling cable to the counterweight, without requiring continuous contact between a sliding contact brush and a wire for the length of counterweight travel, and without requiring the placement of a battery on the counterweight which is charged via an energized rail and contact shoe.

Figure 2:
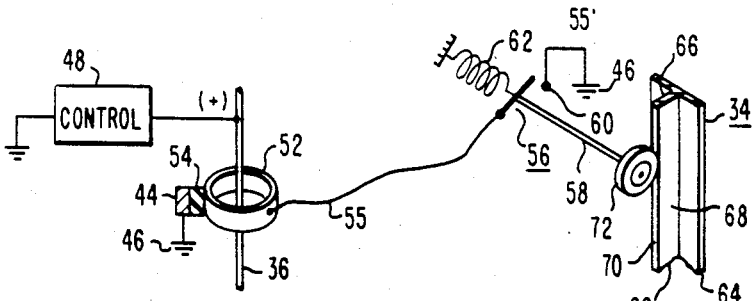
FIG. 2 is a partially schematic diagram which illustrates the teachings of the invention.

FIG. 2 schematically sets forth the teachings of the invention. A metallic ring 52, similar to the uninsulated ring 42 shown in FIG. 1, encircles wire 36, but instead of connecting ring 52 directly to the grounded counterweight frame 44, it is electrically insulated from frame 44, as indicated by electrical insulation 54. Wires 55 and 55' connect ring 52 to ground 46 via a switch 56 mounted on the counterweight 14, such as by a microswitch having an actuating arm 58 and a contact set 60. A spring 62 biases the contact set 60 towards the closed position of the switch 56. The contact set 60 is opened against the bias of spring 62 by disposing actuating arm 58 against the counterweight guide rail 34. Guide rail 34 has a substantially T-shaped cross-sectional configuration, having stem and back portions 62 and 64, respectively. Stem portion 62 has first and second flat, opposed side guide surfaces 66 and 68, respectively, and a flat guide surface 70 located at the stem nose which extends between the side guide surfaces 66 and 68. A roller 72 mounted at the extreme outer end of the actuating arm 58 is preferably disposed to contact and roll on the flat guide surface 70. Thus, any horizontal movement of the counterweight 14 and/or movement of guide rail 34, sufficient to move roller 72 off of the guide surface 70, will result in switch 56 being operated to its closed position, electrically grounding metallic ring 52. Thus, the control circuitry 48 will be armed or enabled to detect contact between wire 36 and ring 52. For example, a conductive solid state switch in control 48, such as a transistor, may be turned off by such contact, changing the state of a relay formerly energized by the conductive solid state switch. Thus, actual physical damage to the elevator system is required before the control 48 is armed or enabled, unlike the prior art arrangement.

Figure 3:
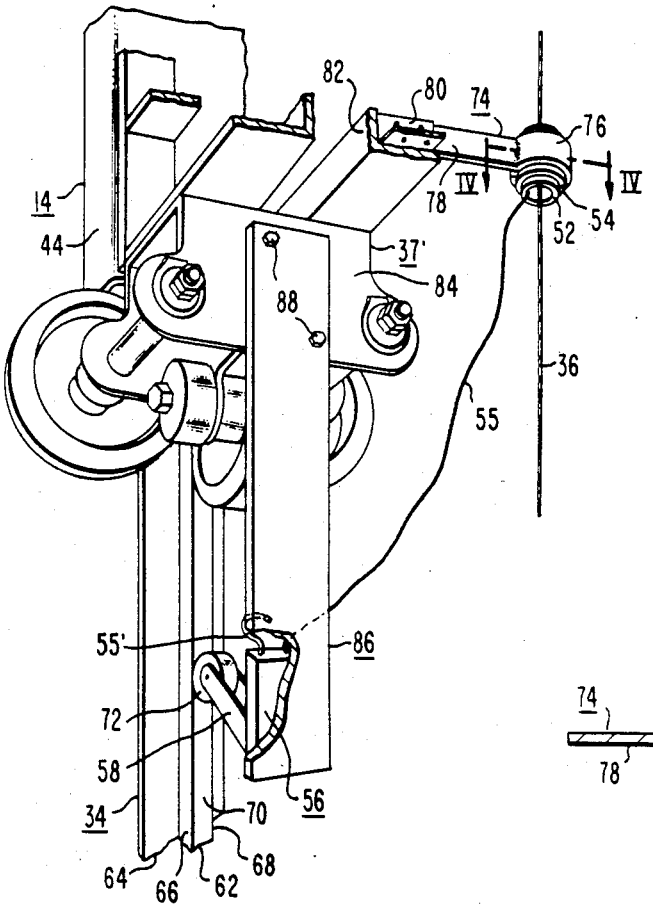
FIG. 3 is a fragmentary, perspective view illustrating an exemplary mounting arrangement for the electrically insulated ring and microswitch shown in FIG. 2.
Figure 4:
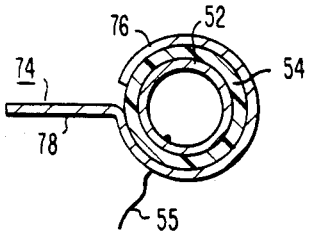
FIG. 4 is a cross sectional view taken through the electrically insulated ring shown in FIG. 3, in the direction of arrows IV—IV.

FIG. 3 is a fragmentary, perspective view of suitable mounting arrangements for mounting the insulated metallic ring 52 and switch 56 on the counterweight 14. As illustrated in FIG. 4, which is a cross sectional view of ring 52 taken between and in the direction of arrows IV—IV in FIG. 3, electrical insulation 54 may be disposed to completely surround ring 52, and a mounting bracket 74 mounts the insulated ring to the counterweight frame 44. For example, bracket 74 may include a ring portion 76 which tightly encircles the insulated ring, an integral arm 78, and an L-shaped member 80 which connects arm 78 to a beam 82 of the counterweight frame 44.

Switch 56 may be suspended from the metallic mounting frame 84 of the counterweight guide roller assembly 37' via a metallic bracket arm 86. Wire 55 interconnects metallic ring 52 with a first electrical lead of switch 56, and wire 55' connects a second electrical lead of switch 56 to a grounded portion of the counterweight, such as to bracket arm 86. Arm 86 is connected to the metallic frame 84 of the guide roller assembly via bolts 88, and frame 84 is bolted to the counterweight frame 44 via bolts not shown in FIG. 3.

A counterweight derailment detector constructed according to the teachings of the invention may thus be installed on new or existing elevator installations quickly and easily by merely attaching two brackets 74 and 86 to the counterweight 14, with bracket 74 including the insulated metallic ring 52 and bracket 86 including switch 56. Wire 55, which may be pre-connected to ring 52, is connected to one side of switch 56. The other side of switch 56 may be pre-connected to bracket arm 86. Ring/wire type counterweight detectors of the prior art may be just as quickly replaced, without modification to the control 48.

I claim as my invention:

1. A traction elevator system including an elevator car and an electrically grounded counterweight mounted for guided vertical movement in the hoistway of a building via car and counterweight guide rails, a vertically oriented metallic wire strung tautly in the hoistway, a metallic ring carried by the counterweight which normally encircles the wire without contact therewith, and control means connected to the wire for detecting electrical contact between the metallic wire and ring, the improvement comprising:

means mounting said metallic ring on said electrically grounded counterweight such that the ring is electrically insulated from the counterweight, switch means having open and closed positions, means mounting said switch means on said counterweight such that the switch means is normally in said open position, switching to said closed position in response to a predetermined abnormal horizontal movement of the counterweight, and means electrically connecting said switch means between said metallic ring and said electrically grounded counterweight, grounding said metallic ring when the switch means is in said closed position to enable the control means to detect contact between the metallic ring and wire.

2. The traction elevator system of claim 1 wherein the switch means includes an actuating arm, and the means which mounts the switch means on the counterweight mounts the switch means with its actuating arm in contact with a counterweight guide rail.

3. The traction elevator system of claim 2 wherein the counterweight guide rail includes a stem portion having first and second opposed side guide surfaces, and a nose guide surface which extends perpendicularly between the side guide surfaces, with the actuating arm of the switch means normally engaging said noise guide surface.

* * * * *